US008641865B2

(12) United States Patent
Engstrom et al.

(10) Patent No.: US 8,641,865 B2
(45) Date of Patent: Feb. 4, 2014

(54) METHOD AND SYSTEM FOR THIN CHIP DIGESTER COOKING

(75) Inventors: Johan Engstrom, Grankulla (FI); Jussi Piira, Helsinki (FI); Janne Vehmaa, Siltakylä (FI); Veli-Pekka Tervola, Espoo (FI); Aaron Leavitt, Alpharetta, GA (US)

(73) Assignee: Andritz Technology and Asset Management GmbH, Graz (AT)

( * ) Notice: Subject to any disclaimer, the term of this patent is extended or adjusted under 35 U.S.C. 154(b) by 143 days.

(21) Appl. No.: 12/950,342

(22) Filed: Nov. 19, 2010

(65) Prior Publication Data

US 2011/0120663 A1 May 26, 2011

Related U.S. Application Data

(60) Provisional application No. 61/263,905, filed on Nov. 24, 2009.

(51) Int. Cl.
*D21C 9/08* (2006.01)

(52) U.S. Cl.
USPC ..... 162/55

(58) Field of Classification Search
USPC ..... 162/55
See application file for complete search history.

(56) References Cited

U.S. PATENT DOCUMENTS

| | | | | |
|---|---|---|---|---|
| 3,475,271 | A * | 10/1969 | Laakso | 162/242 |
| 4,190,490 | A * | 2/1980 | Tomlinson, II | 162/19 |
| 4,236,961 | A | 12/1980 | Green | |
| 5,203,963 | A | 4/1993 | Henricson | |
| 5,736,006 | A | 4/1998 | Prough | |
| 5,968,314 | A | 10/1999 | Prough | |
| 6,361,649 | B1 * | 3/2002 | Snekkenes | 162/17 |
| 2004/0089431 | A1 * | 5/2004 | Fant et al. | 162/29 |
| 2005/0279468 | A1 | 12/2005 | Stromberg | |

FOREIGN PATENT DOCUMENTS

WO 98/35091 8/1998

* cited by examiner

*Primary Examiner* — Jacob Thomas Minskey
(74) *Attorney, Agent, or Firm* — Nixon & Vanderhye P.C.

(57) ABSTRACT

A method to cook thin chips in a continuous digester vessel including: introducing thin chips having a thickness of no more than 6 mm, into a chip bin; adding white (cooking) liquor to the chip bin or to a chip transport passage extending from the chip bin to an upper inlet of the continuous digester vessel; injecting medium pressure steam or another heated fluid to an upper region of the digester vessel to elevate a cooking temperature of the chips in the vessel to at least 130 degrees Celsius; cooking the chips in the vessel as the chips flow downward through the vessel without substantial extraction or introduction of liquor in the cooking section of the vessel; injecting wash liquid to a lower region of the vessel; extracting at least wash liquid through a wash liquid extraction screen in the lower region of the vessel and above the injection of the wash liquid, and discharging the cooked thin chips from the lower region of the vessel.

6 Claims, 1 Drawing Sheet

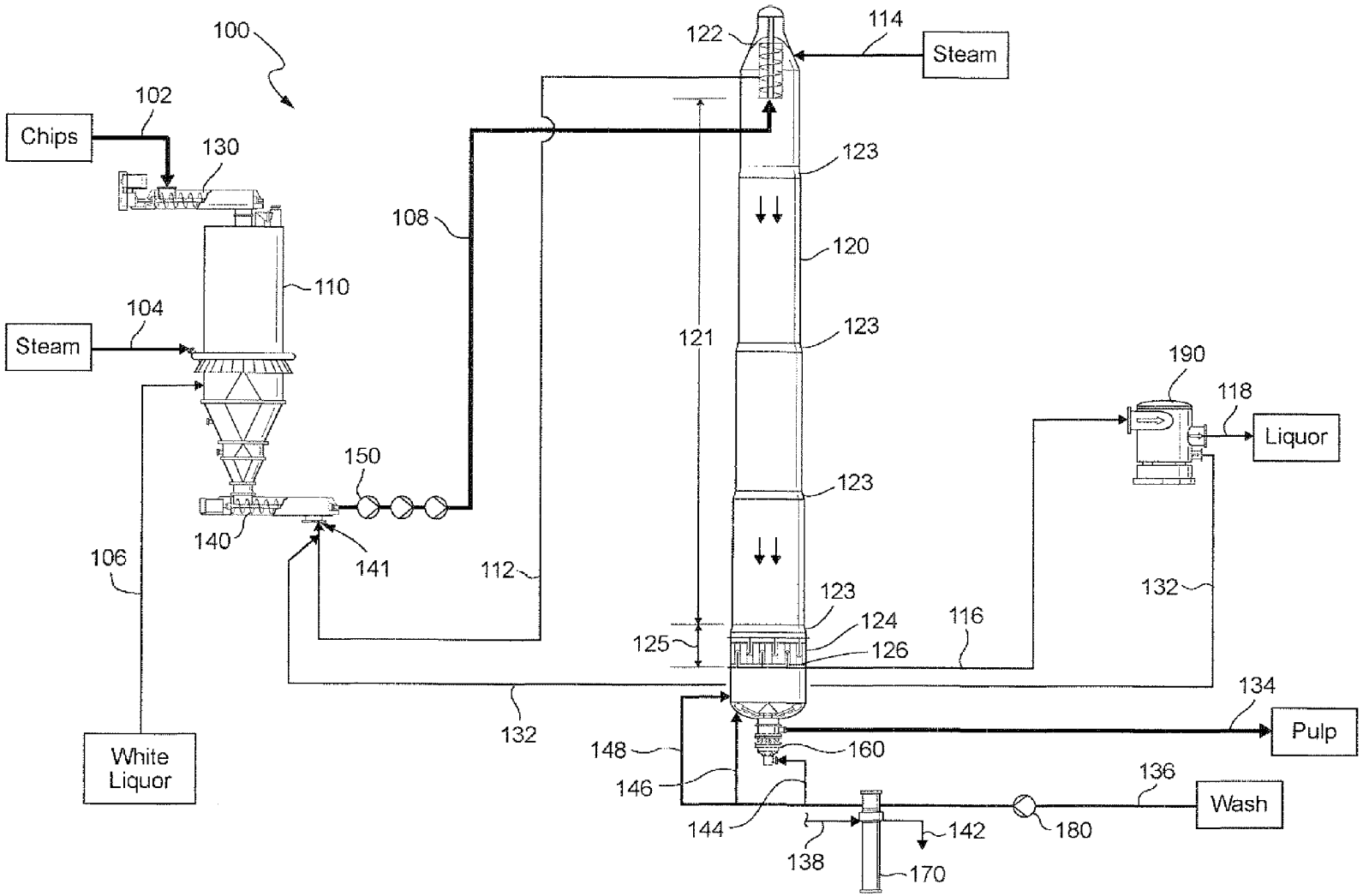
Liquor
Pulp
Wash
Steam
Chips
Steam
White Liquor
100
102
104
106
108
110
112
114
116
118
120
121
122
123
124
125
126
130
132
134
136
138
140
141
142
144
146
148
150
160
170
180
190

METHOD AND SYSTEM FOR THIN CHIP DIGESTER COOKING

CROSS RELATED APPLICATION

This application claims the benefit of application Ser. No. 61/263,905 filed Nov. 24, 2009, which is incorporated in its entirety by reference.

BACKGROUND OF THE INVENTION

The present invention generally relates to methods and systems for producing a pulp from lignocellulosic material, such as wood chips, using chemical cooking techniques. The pulp may be produced in a continuous flow chemical digester vessel.

Lignocellulosic material, such as wood, is conventionally comminuted into wood chips before being cooked in a digester vessel, such as a continuous or batch vessel. The size of the wood chips has primarily been set to enhance digester performance and, particularly, to avoid plugging the bottom of the digester vessel with collapsed chips.

Softwood chips are typically cooked to Kappa numbers of 20 to 33 and hardwood chips are cooked to a Kappa numbers of 15 to 20. The Kappa number indicates the residual lignin content of wood pulp. At these conventional Kappa numbers, thin chips, e.g., chips having a thickness of less than 7 mm, become soft and easily compressed at the bottom of the digester vessel.

Compressed, soft thin chips become densely packed at the bottom of the digester vessel, plug the bottom and impede the flow of wash liquor through the chips in the wash zone of the digester vessel. When compression of soft chips is severe, the bottom of the digester becomes choked with chips such that insufficient liquid flows through the chips in the column of chips in the vessel. Under such conditions, a mass transfer problem can arise in which the chips no longer move uniformly downward to the chip discharge outlet at the bottom of the vessel.

Compressed soft, thin chips can form chip agglomerations that plug and block chip flow down through the lower portion of a digester vessel. Channels may form in the thin chip agglomerations that allow some chips to flow to the bottom of the vessel while other chips are bound in the agglomeration. The channels are not desired as they are inconsistent with uniform chip flow down the digester vessel and allow the agglomerations of chips to remain in the vessel for extended periods.

Chip agglomerations may inhibit wash liquids intended to flow through the chips to remove used or spent cooking liquor (black liquor) and lignin prior to exiting the chips/pulp exiting the digester. An agglomeration of cooked thin chips at the bottom of a digester vessel can inhibit the removal of black liquor before the chips are discharged from the digester vessel. An agglomeration of cooked thin chips may also plug or block the screens in the sidewalls of the digester vessel.

A high content of very thin chips and pin chips (collectively referred to as "small chips") can cause problems in an upper portion of a digester vessel. Small chips may plug the screens in the upper regions of the digester vessel. Plugged screens prevent the extraction of liquor from the upper portion of the digester vessel.

When the vessel becomes excessively compacted, the continuous cooking operation is temporarily stopped and cold liquor added to the bottom of the digester to cool down, break up and remove the agglomeration of chips. The lower pulp production rate or temporary halt to chip production results in a reduction in the pulp production realized by the mill and higher maintenance costs.

Due to the difficulty in processing thin and small chips, an average chip thickness of 8 mm is a standard minimum sized chip to be formed at a mill for use in a continuous digester vessel. When the average chip length is 22 mm (millimeter) to 30 mm in length, the thickness of the chips is generally less than 8 mm, with 85% to 90% of the chips having a thickness in a range of 8 mm to 2 mm.

Chip screens in the chip feed system are commonly used to select chips having an acceptable thickness. The screens may be positioned at an inlet to the chip bin for the digester vessel. A chip screen may have first screen of 8 mm slots and second screen having 7 mm diameter holes. Chips are selected as those that pass through the first screen and are retained by the second screen. Screening chips is a technique for classifying the chips. Chip classification is commonly done according to a SCAN-CM 40:01 chip size distribution analyzing method. According to this method, acceptable chips for continuous digesting are those that pass through an 8 mm slot and are retained on a tray with 7 mm holes.

Conventional wisdom is that large amounts of thin and small chips should not be processed in a conventional continuous digester vessel. Thin and small chips, such as pin chips and sawdust, are conventionally processed in a Pandia Digester offered by GL&V, Bauer M&D digesters and Metso pin chip processes, or a specially adapted Kamyr® digester.

To avoid the problems associated with small and thin chips, the conventional wisdom has been that chips for a conventional continuous digester should be sufficiently large, e.g., average chip thickness of 8 m and lengths 25 to 30 mm for softwood and 22 to 24 mm for hardwood, to avoid excessive softening the chips in the digester vessel.

BRIEF DESCRIPTION OF THE INVENTION

There is a need for a method and system for chemically digesting thin chips, such as in a continuous flow digester vessel. Such a method and system may avoid or minimize the difficulties conventionally associated with cooking thin chips in a vertical continuous digester vessel. It would be desirable if the method and system for digesting thin chips minimized the halts to digester production which are needed to break up an agglomeration of soft chips plugging the digester.

A method has been conceived and is disclosed herein to cook thin chips in a continuous digester vessel comprising: introducing a flow of thin chips in which at least 85% of the chips have a thickness of no greater than 6 mm; adding liquor to the chip bin or to a chip transport passage extending from the chip bin to an upper inlet of the continuous digester vessel; injecting steam or other heated fluid to an upper region of the digester vessel to elevate a cooking temperature of the chips in the vessel to at least 130 degrees Celsius; cooking the chips in the vessel as the chips flow downward through the vessel without substantial extraction or introduction of liquor in the cooking section of the vessel; injecting wash liquid to a lower region of the vessel; extracting at least the wash liquid through a wash liquid extraction screen in the lower region of the vessel and above the injection of the wash liquid, and discharging the cooked thin chips as pulp from the lower region of the vessel.

Substantially all of the white (cooking) liquor may be added in the chip bin and the chip transport passage and substantially no white liquor is added in the digester vessel. The chips and cooking liquor in the digester vessel flow in a uniformly downward direction through the vessel to the wash liquid extraction screen. Substantially the entire height of a chip column in the digester vessel may be maintained at a temperature of at least 130 degrees Celsius and at a pressure of at least 2 bar gauge.

At least 85% of the chips may have a thickness greater than 2 mm. The pulp discharged from the digester vessel may have a Kappa number of at least 50 for softwoods and at least 25 for hardwoods. The steam or the other heated fluid injected to the digester vessel may be at a pressure of at least 2 bars gauge.

An apparatus to pulp thin wood chips has been conceived and is disclosed herein comprising: a chip screen receiving chips of comminuted cellulosic material, the screen assembly including a screening assembly which outputs thin chips in which at least 85% of the chips have a thickness of no greater than 6 mm; a chip bin and conveyor assembly receiving the thin chips output from the chip screen, the chip bin assembly including a chip bin having an inlet to receive white liquor and said chip bin having an operating mode in which a lower portion of the chip bin is flooded with white liquor while thin chips move through the chip bin to a discharge outlet of the chip bin, and the chip bin and conveyor assembly including a conveyor discharging the thin chips to a transport conduit; a continuous digester vessel having an chip inlet at an upper region of the vessel coupled to the transport conduit, a cooking zone extending vertically from the upper region of the vessel to a wash zone, a wash zone extending from the cooking zone to a bottom region of the vessel and a pulp discharge outlet in the bottom region; an inlet to receive steam or other heated fluid at the upper region of the inlet, an upper region of the digester vessel to elevate a cooking temperature of the chips in the vessel to at least 130 degrees Celsius; and the wash zone including a wash inlet to digester vessel to receive wash liquid and a screen assembly proximate to the wash inlet, the screen assembly including a screen adjacent and a wash filtrate chamber on a side of the screen adjacent the chips in the wash zone.

BRIEF DESCRIPTION OF THE DRAWINGS

FIG. 1 is a schematic illustration of an exemplary embodiment of a method and system for digesting thin chips.

DETAILED DESCRIPTION OF THE INVENTION

A new cooking method and system have been conceived and is disclosed herein for cooking thin chips in a continuous chemical digester, and useable with various chemical cooking process, such as kraft and soda process. Cooking thin chips with the method and system disclosed herein may solve or reduce the mass transfer problems associated with thin chips in conventional kraft continuous digester cooking.

Thin chips may be comminuted lignocellulosic chips in which 85% to 90% of the chips have thicknesses of 2 mm to 6 mm. The thin chips can be generated by adjusting conventional chippers in a mill supplying the chips and by adjusting conventional screening devices that screen the chips entering the chip bin for a continuous digester.

The cooking conditions in a continuous digester vessel for thin chips may be less severe than the conditions typically used to cook conventional thicker chips. For example, the digester vessel may product pulp from softwood thin chips having Kappa numbers of at least 50 and be in any of ranges of 50 to 100, 50 to 80, and 60 to 75. Similarly, pulp from hardwood thin chips may have Kappa numbers of at least 25, and be in a range of 25 to or be above 50. These high Kappa numbers may be achieved even though the period for impregnating the chips with a cooking liquor is short. The chips may be impregnated with white cooking liquor in the chip bin and thereby avoid a separate chip impregnation device.

The cooking of thick chips is presently believed to be mass transfer limited in the early stage of the cooking. Mass transfer relates to the transfer of cooking chemicals into the chips and to the fibers within the chips. Mass transfer can be improved by increasing temperature, using thinner wood chips and higher OH-concentration. Higher temperatures can be problematic because they may cause a higher consumption of OH. The inventors propose using thinner wood chips and high OH-concentration as a practical approach to improving the mass transfer of cooking chemicals to the fibers in the wood chips.

The conventional problems of thin wood chips becoming too soft in a chemical digester vessel appear to be due, at least in part, to excessive permeability of thin chips in the digester vessel. The permeability of chips depend on the size of the chips, porosity of the chips, and the Kappa number of the chip. A lower Kappa number may provide for lower permeability of the chip, and a higher Kappa number may provide for a higher permeability of the chip.

A chip feed system, e.g., a chip bin, having enhanced penetration of the chips by a white cooking liquor may not need a separate impregnation stage. In an embodiment, the target is to cook softwood thin chips to Kappa numbers of over 50, in a range of 50 to 70 and over 70 and hardwood thin chips to Kappa numbers of over 25, in a range of 25 to 50 or over 50. These high Kappa numbers are possible because the cooking conditions are mild and thin chips are easily cooked. The cooking and impregnation may be carried out using same liquor.

The alkali penetration of the white liquor into the thin wood chips may be fast, and will be faster if the liquor wood ratio is low. A high alkali content in the white liquor accelerates the penetration of the chips. The white liquor may be about 60 percent (%) to 70% total alkali. The alkali may be transferred to thin chips without a long impregnation retention time in the chip bin or digester vessel. Further, the diffusion of cooking chemicals into the chips after the initial impregnation of the chips may be less critical because of a high alkali concentration of the white liquor.

The Kappa number may high, e.g., greater than 50 for softwoods and greater than 25 for hardwoods, and the porosity of the pulp/chips discharged from the digester vessel may be maintained and a sufficient washing and cooling can be carried out in the bottom of the digester. If the alkali concentration in the white liquor is high, the alkali penetration and diffusion into the chips will proceed quickly. Due to the fast penetration, alkali may be transferred to thin chips without a long impregnation period. The chip retention period in the chip feed system and digester vessel need be relatively short. If chip impregnation is achieved quickly, e.g., in 2 to 5 minutes, the impregnation stage may be performed in the chip bin and a separated impregnation stage may not be necessary.

The cooking of the chips in the white liquor may be done at a mild temperature (e.g., at or above 130 degrees Celsius (° C.)) in the digester vessel 120. The thin chip cooking process may employ cooking temperatures lower than the temperatures (150 to 180 degrees Celsius) of conventional cooking processes.

The conventional cooking control parameter (H-Factor) may not be a sufficient indicator of the cooking process of thin chips, and may not be best used to calculate retention time or cooking temperature for the thin chip cook process. The lower cook temperature of the thin chips may protect the pulp during the first minutes of exposure to the cooking conditions in the digester vessel. In the thin chip cooking process the cooking time is over two hours of the chips in the digester vessel 120.

A digester vessel 120 cooking thin chips at cooking conditions yielding pulp with such high Kappa numbers should produce chips that are not too soft. The thin chips produced under these cooking conditions should withstand the forces at the bottom of the chip column in the digester vessel without becoming excessively compressed, packed or agglomerated at the bottom of the digester vessel.

Once cooked, thin chips/pulp tend to easily disintegrate at the bottom of the digester vessel and after discharge from the digester vessel, such as in the fiberline process downstream of the vessel. The easy disintegration the chips/pulp may render unnecessary the recirculation of unprocessed chips from the bottom of the digester vessel back to the top inlet of the vessel.

By avoiding the recirculation of chips, the yield from the bottom of the digester of thinner chips may result in a chip yield increase of 3 percent (%) to 15% over conventional cooking of thicker chips. For example, under conventional cooking conditions, the yield of softwood is typically 45% to 50% when using Lo-Solids® Cooking as sold by Andritz Inc. Using the thin chip cooking method, yields of pulp may be 48% to 65% which are a significant increase over conventional pulp yields.

Other benefits of the thinner chip cooking method may include less complicated equipment and fewer equipment components, as compared to conventional continuous chip digesting systems. Further, the pulp discharged from the digester vessel may be used directly as brown pulp to form brown packaging material that does not require bleaching of the pulp. In addition, the pulp discharged from the digester vessel may be sufficient to form bleachable paper and other white paper products because the pulp is in fiber form with low reject pulp.

FIG. 1 is a schematic illustration of an exemplary embodiment of a cooking system 100 for thinner chips. The cooking system 100 includes a chip bin 110 and a continuous flow, chemical digester vessel 120. The cooking system 100 includes a white liquor input line 106, e.g., a pipe or other conduit, that adds white liquor to the thin chips in the chip bin. Additional cooking liquor may be add as the chips are discharged from a chip conveyor 140 and are pumped 150 through chip feed line 108 to the digester vessel 120.

The white liquor added to the chip bin and chip conveyor may be sufficient for cooking the chips in the digester vessel 120, such that additional cooking liquor need not be added to the digester vessel. The white liquor may be mixed with or substituted by green liquor or other cooking liquids. Wash liquid and other liquor may be added to the digester vessel 120 and to chip transport lines 108 to facilitate chip flow through transport lines and chip discharge from the digester vessel.

Thin chips may have a particle size distribution in which 85% or more of the chips have a thickness of no greater than 6 mm. The chips being transported through a chip feed line 102 may be screened prior to entering a chip screw device 130 at the inlet to the chip bin 110 or as the chips leave the bin 110 and enter a chip metering and conveyor device 140.

A chip screening device screening device 119 may be a conventional screening device except for smaller openings for screening the chips. For example, to obtain chips having an average thickness of 6 mm the screening device 119 may have 6 mm slots in a first screen and 5 mm or 4 mm holes in a second screen. Chips that pass through the first screen but not the second screen are fed to the chip bin 110.

The chips are fed via the screw conveyor 130 to the chip bin 110. The chip bin 110 may be a conventional chip bin, such as the Diamondback® chip bin supplied by Andritz Inc. Low pressure steam may be added via steam line 104 to chip bin 110, such that the temperature and pressure of the chips in the chip bin may be controlled. The chip bin 110 may also operate as a pre-steaming stage to heat and soften the chips.

White liquor may be added via line 106 to the chip bin 110 to impregnate chips with cooking liquid while they are in the bin and the chip transport line 108. The white liquor may partially flood the chip bin with liquor. The white liquor may be added at a lower elevation of the chip bin to facilitate transportation of the chips to the chip metering and conveyor screw 140 or other type of conveyor located at the bottom of the chip bin. Liquor may be added in the chip bin or in the chip transport stream to reduce the chip density of the chip slurry flowing to the top of the digester and thereby facilitate the transport and pumping of the slurry.

The chips may presteamed in the chip bin and retained in the chip bin for a pre-steam residence time of 5 min to 60 min. Thorough and complete pre-steaming of the thin chips enhances the mass transfer into the chips of the cooking liquid (and purging air from the chips), facilitates the cooking of the chips in the digester vessel and reduces the risk that the chips will plug the bottom of the digester vessel. After presteaming, the chips may be transferred to a liquid, e.g., a transport liquid. Chips may be soaked with the cooking liquor as the chip slurry is fed to and through the feeding device.

Recycled liquor and other liquids, e.g., black liquor, recovered from a black liquor filter 190, a top separator 122 in the digester vessel 120 and other locations in the pulping process, e.g. wash filtrate, may be injected into the chips by a nozzle 141 near the discharge end of the chip conveyor 140 to facilitate transportation of the impregnated chips to one or more pumps 150, e.g. a TurboFeed® chip feeding system, through chip transport pipe (line) 108 to an inverted top separator 122 of the digester vessel 120.

One or more chip feeding devices 150 may pressurize the chip and liquor slurry. The chip feeding device may be one or more of a high pressure feeder (HPF), a pump(s) and a feed valve. Prior to the feeding device there may be a chip tube, chip tank or chip vessel, in which the liquor level may be controlled and which temporarily holds the chips. This system (which includes thin chips) may facilitate the immediate penetration of cooking liquor as well as chip neutralization.

The digester vessel 120 may employ a continuous process, such that chips and steam are continuously being added to the top of the digester 120 and pulp is continuously discharged from the bottom of the digester. The residence period of the chips in the digester vessel 120 is dependent on specific cooking conditions and the digester vessel.

The top separator 122, e.g., an inverted top separator, may extract a portion of the liquor in the chips entering the separator. The extracted liquor flows through a liquor recirculation line 112 to be injected via nozzle 141 into the chip flow at the discharge of the chip conveyor 140. The top separator 122 is optional and, if removed, the chips may be discharged directly into the top of the digester vessel 120 without the extraction of liquor.

The digester vessel 120 includes a controlled pressure steam inlet line 114. The addition of steam via line 114 provides a means for controlling the cooking pressure and temperature in the digester vessel. Steam pressure in line 114 may be controlled in a conventional manner to achieve a desired temperature in the digester vessel 120 and avoid flashing of the steam in the vessel.

The chips in digester vessel 120 may be heated to the cooking temperature quickly after entering the top of the digester vessel. The steam (e.g., medium pressure, low pressure steam or steam from digester or evaporator equipment) added at the top of the digester vessel quickly brings the chips to a cooking temperature, e.g., 130 degrees Celsius or above, as the chips enter the vessel through the top separator. The steam added via line 114 to the top of the digester vessel may be at medium or low pressure as required to meet the temperature requirements of the cooking process in the vessel.

In an exemplary embodiment, the digester vessel 120 operates at a pressure of at least 2 bars gauge and at a temperature of at least 130° C. These are cooking conditions under which the thin chips are processed in the digester vessel. The single digester vessel cooking system shown in FIG. 1, may be embodied as a two or more vessel cooking system configured for thin chip cooking and to operate under similar cooking conditions as are disclosed herein.

The flow of the thin chips, e.g. the chip column, through the digester vessel 120 may be a unidirectional downward flow and a uniform chip flow across the entire cross-section of the chip column. The digester vessel may not have cooking liquor recycle loops, cooking liquor countercurrent flow or extraction cooking screens at multiple elevations in the vessel. The cooking zone 121 of the vessel may be cylindrical with smooth and uniform cylindrical walls, which may expansion rings 123 where the diameter of the vessel expands. The interior walls of the cooking zone 121 may be free of screens, nozzles and other devices to add or extract fluid to the cooking zone.

The digester vessel 120 may further include one or more inlets for wash liquid, which may be water. The wash liquid mixes passes through the chips/pulp in a wash zone 125 in a lower section of the digester vessel.

Wash liquid may be added to the digester vessel via wash lines 148, 146 and 144 to the digester vessel 120. Wash liquid enters the system 100 via line 136, where it is optionally pressurized. A pump 180 may move the wash liquid towards the wash zone and may pressurize the wash liquid. Optionally, the wash liquid may be thermally adjusted (e.g., heated or cooled) via a heat exchanger 170. In certain embodiments, the heat exchanger 170 may use warm water via 138 as a cooling medium, and in such a case, hot water exits the heat exchanger via line 142. The heat exchanger 170 may be known as a cold blow circulation unit.

After the optional pressure and temperature adjustment, wash liquid may be split into at least three lines 144, 146 and 148. Wash liquid flowing through line 144 enters the bottom of the digester 120 and inhibits clogging of the pulp at discharge outlet 160, and adds liquid to promote flow of the chips through discharge line 134. Wash line 146 may also inhibit chip clogging by injecting wash liquid upward into the bottom of the vessel imparting to agitate the pulp in the bottom of the vessel. Wash liquid injected to the bottom of the vessel via line 148 similarly may inhibit clogging by imparting a horizontal force on the pulp and thereby agitate the pulp. The wash liquid may also assist in diluting or removing the spent liquor that may or may not be entrained in the cooked chips.

The digester vessel 120 includes a wash screen 124 adjacent a wash zone 125 below the cooking zone. The wash screen 124 separates at least a portion of the liquid, which may include spent liquor, wash liquid, water and other filtrate liquids. The filtrate liquids pass through the wash screen and into an annular filtrate chamber 126 on a side of the screens opposite to the flow of chips down through the digester vessel.

The separated liquid, commonly referred to as black liquor or filtrate, is drawn from the chamber 126 into wash filtrate extraction line 116 and flows to a black liquor filter 190. The filtered strong liquor exits the black liquor filter 190 via line 118, and a filtered weak black liquor exits the black liquor filter 190 via liquor recirculation line 132. The filtered weak liquor may be circulated, in whole or in part, back to the chip screw conveyor 140. The liquor exiting the black liquor filter 190 via line 118 may pass through a cooler which extracts heat energy and flow to a further process stage, such as a flash tank or recovery boiler.

The pulp, e.g., cooked thin chips, is discharged from the digester vessel 120 via a pulp transport line 134. Little or no additional refining or pulping may be needed after the pulp is discharged from the digester vessel. The discharged pulp may be used as brown stock to form corrugated paper and other materials. Alternatively, the brown stock may be washed using conventional pulp washing techniques.

After being discharged from the digester vessel 120, the pulp may be optionally washed, such as before proceeding to a bleaching or delignification stage. The separate wash step may be a conventional brown stock wash stage involving washing with the DD-washers offered by Andritz Inc. or other conventional washing equipment to remove cooking liquor remaining with the material after the washing stage within the digester, diffusers or vacuum filters. Alternatively, the further washing step may be unnecessary if the pulp is sufficiently washed in the wash zone 125 of the digester vessel.

The washed pulp may be whitened in an oxygen delignification stage (O2-stage) or other bleaching process. For example, the pulp may be treated in an O2-stage to inject oxygen to the pulp stock to continue the delignification of the pulp. If the oxygen delignification stage is strong, the conditions in the digester vessel 120 may be adjusted to produce pulp with a reduced Kappa number of 15 to 30 for soft woods and 10 to 20 for hard woods. Reducing the Kappa number allows the pulp to be bleached in conventional totally chlorine free (TCF) and elemental chlorine free (ECF) bleaching stages.

Chives and other small wood pieces, e.g., splinters and rejection pieces, may be processed in the delignification stage as they need not be circulated back to the digester. Further, chives may be sufficiently small that the O2-stage alone can remove the lignin. Accordingly, chives may flow directly to the O2-stage without passing through the digester vessel.

The thin chip cooking process described herein produces a pulp requiring less washing, oxygen delignification, screening and bleaching than pulp produced by traditional high Kappa cooking methods. The cooking system 100 need not require long chip impregnation periods.

The methods and systems described in this application may not require a high liquor to wood ratio during the impregnation. For instance, it may be preferable that liquor impregnation times of less than 2 hours, and liquor to wood ratios of less than 7 may be used for cooking the thin chips.

A majority or all of the white liquor used for pulping the chips may be introduced in the beginning (e.g., in the chip bin 110 or feed system circulation) of the cooking system 100. This early introduction of white liquor may result in a high chip alkalinity and concomitant enhanced diffusion rate of the liquor into the chips. In certain embodiments, the system may have a short impregnation periods for the chips and the temperature of the chips can be raised to cooking temperature, e.g., 130 degree Celsius to 160 degree Celsius, directly in the top of the digester in a one vessel system (e.g., impregnation in the lower part of the chip bin and impregnation vessel 110 or in the feeding circulation or in the top of the digester may be sufficient). Although illustrated as one vessel, the chip bin and impregnation vessel 110 may be separate vessels.

The withdrawal of liquor from the chips may occur only at the end of the cooking process. In certain embodiments of thin chip cooking, the cooking system 100 may be simplified as compared to conventional cooking with thicker chips. Thin chip cooking may be suitable for retrofits of previously existing mills and newly built mills. For example, a high Kappa pulp is possible to produce without an in-line refiner.

Because the amount of black liquor produced and discharged to line 118 from cooking thin chips in the manner discussed above is less than the amount of black liquor that would be expected to be produced in a conventional thick chip cooking process, the recovery boiler needed for the black liquor from line 118 may be smaller that the recovery boiler needed for larger chips. In particular, the high yield of pulp which results in the above described thin chip chemical pulping process yields fewer by-products to burn in the recovery boiler. Similarly, the white liquor plant needed to produce white liquor for the thin chip chemical pulping process may be may be smaller or minimized, as compared to the white liquor plant needed for a conventional thick chip chemical pulping process because the thin chip process requires less white liquor, e.g., the white liquor charge, for cooking than does conventional thick chip cooking.

Associated with the addition of white liquor to the wood chips, there is a penetration stage in which the liquor penetrates the chips. After the penetration stage, a mass transfer of the cooking chemicals into the chips occurs by diffusion of the chemicals into the chips. Thinner wood chips may enhance the mass transfer. Because of the enhanced mass transfer, the delignification during cooking may be improved and the temperature may be raised at the top of the digester directly to the cooking temperature. For instance, if the thickness of the wood chip is half of the thickness of a standard wood chip, the time needed to achieve liquor penetration of the thin chips may be a quarter of the time needed for liquor to penetrate a thick wood chip.

The thin chip cooking system 100 may provide a cost-effective chip and pulp processing system with high Kappa cooking. The cost may be held low because it may not be necessary to refine the chips or pulp generated by the disclosed thin chip processing system. The thin chip cooking system may also be efficient in that they system may produce more pulp using the same amount of wood as compared to a conventional thick chip cooking system and, thus, provide a significant yield increase as compared to conventional thick chip digesting processes.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method to cook thin chips in a continuous digester vessel comprising:

introducing a flow of thin chips in which at least 85% of the chips have a thickness of no greater than 6 mm and no thinner than 2 mm;

adding white liquor to the chip bin or to a chip transport passage extending from the chip bin to an upper inlet of the continuous digester vessel;

injecting steam or other heated fluid to an upper region of the digester vessel to elevate a cooking temperature of the chips in the vessel to at least 130 degrees Celsius;

cooking the chips in the vessel as the chips flow downward through the vessel without substantial extraction or introduction of liquor in the cooking section of the vessel;

injecting wash liquid at or adjacent a discharge outlet at the bottom of the vessel;

extracting from the chips at least a portion of the wash liquid and a portion of black liquor from the vessel through a wash liquid extraction screen in or surrounding the vessel, wherein the wash liquid extraction screen is above the injection of the wash liquid, and discharging the cooked thin chips as pulp from the discharge outlet, wherein the pulp discharged from the vessel has a Kappa number of at least 50 for pulp formed from softwood thin chips and at least 25 for pulp formed form hardwood thin chips, wherein the introduction of the flow of thin chips, the cooking of the chips and the discharge of the cooked thin chips are performed simultaneously in the continuous digester vessel.

2. The method of claim 1 wherein substantially all of the white liquor is added in the chip bin and the chip transport passage.

3. The method of claim 1 wherein the chips and cooking liquor in the digester vessel flow in a uniformly downward direction through the vessel to the wash liquid extraction screen.

4. The method of claim 1 wherein substantially the entire height of a chip column in the digester vessel is maintained at a temperature of at least 130 degrees Celsius and at a pressure of at least 2 bar gauge.

5. The method of claim 1 wherein the steam or the other heated fluid is injected at a pressure of at least 2 bars gauge.

6. The method of claim 1 wherein the continuous digester vessel is a single pressurized vessel.

* * * * *